US009004138B2

(12) United States Patent
Okachi et al.

(10) Patent No.: US 9,004,138 B2
(45) Date of Patent: Apr. 14, 2015

(54) SCREEN DEVICE

(75) Inventors: Yasubumi Okachi, Yokohama (JP); Mitsuharu Watanabe, Yokohama (JP)

(73) Assignee: Metaco Inc., Tokyo (JP)

( * ) Notice: Subject to any disclaimer, the term of this patent is extended or adjusted under 35 U.S.C. 154(b) by 324 days.

(21) Appl. No.: 13/500,430

(22) PCT Filed: Oct. 7, 2010

(86) PCT No.: PCT/JP2010/067683

§ 371 (c)(1),
(2), (4) Date: Jun. 13, 2012

(87) PCT Pub. No.: WO2011/043436

PCT Pub. Date: Apr. 14, 2011

(65) Prior Publication Data

US 2012/0247691 A1 Oct. 4, 2012

(30) Foreign Application Priority Data

Oct. 7, 2009 (JP) ..... 2009-233912

(51) Int. Cl.
*A47H 1/00* (2006.01)
*E06B 9/56* (2006.01)
(Continued)

(52) U.S. Cl.
CPC ..... *E06B 9/54* (2013.01); *E06B 2009/543* (2013.01)

(58) Field of Classification Search
CPC ..... E06B 9/18; E06B 9/11; E06B 9/17007; E06B 9/08; E06B 9/174; E06B 9/54; E06B 2009/543
USPC ..... 160/23.1, 84.06, 98, 194, 240, 265, 160/239, 267.1, 268.1, 270, 271, 313, 314, 160/318, 31, 315
See application file for complete search history.

(56) References Cited

U.S. PATENT DOCUMENTS 4,757,852 A * 7/1988 Jentof et al. ..... 160/23.1
6,186,212 B1 * 2/2001 Tsuchida ..... 160/84.06
(Continued)

FOREIGN PATENT DOCUMENTS

JP 61-78989 5/1986
JP 7-147711 6/1995
(Continued)

OTHER PUBLICATIONS

International Search Report issued Nov. 2, 2010 in corresponding International Application No. PCT/JP2010/067683.

*Primary Examiner* — Katherine Mitchell
*Assistant Examiner* — Jeremy Ramsey
(74) *Attorney, Agent, or Firm* — Wenderoth, Lind & Ponack, L.L.P.

(57) ABSTRACT

In a screen device, to provide a screen device in which a roller pipe includes a revolving shaft 5 on which a coil spring 6 is wound integrated therein, connected to a rotator 52 rotatably disposed with respect to a stator 51 connected to a lower end of the revolving shaft, and is rotatably stored in a housing frame, the stator includes a plurality of radially arranged claws 53, holding portions 57 arranged radially on a lower surface portion of a cap member 55 which is detachably disposed at a lower end of the housing frame corresponding to the claws of the stator are disposed, the holding portions each have a holding space 58 for receiving the claw in the interior thereof, the holding space is opened outward at one end on the side of receiving the claw and closed at the other end to allow adjustment of initial winding of a coil spring integrated in a roller pipe and superior in opening-and-closing operability of a screen and manner it is retracted.

4 Claims, 7 Drawing Sheets

(51) Int. Cl.
*A47G 5/02* (2006.01)
*E06B 9/54* (2006.01)

(56) References Cited

U.S. PATENT DOCUMENTS

| | | | | |
|---|---|---|---|---|
| 6,283,193 | B1 * | 9/2001 | Finch et al. | 160/191 |
| 6,644,378 | B2 * | 11/2003 | Mitchell | 160/191 |
| 6,814,127 | B2 * | 11/2004 | Tagtow et al. | 160/31 |
| 6,896,027 | B2 * | 5/2005 | Crouch | 160/315 |
| 7,717,152 | B2 * | 5/2010 | Moriya et al. | 160/31 |
| 7,810,543 | B2 * | 10/2010 | Donatelli et al. | 160/31 |
| 8,302,655 | B2 * | 11/2012 | Lin | 160/315 |
| 2008/0135189 | A1 | 6/2008 | Okachi et al. | |
| 2011/0240236 | A1 * | 10/2011 | Savard et al. | 160/314 |

FOREIGN PATENT DOCUMENTS

| | | |
|---|---|---|
| JP | 3323461 | 6/2002 |
| JP | 3403652 | 2/2003 |
| JP | 2005-23577 | 1/2005 |
| JP | 2005-351046 | 12/2005 |

* cited by examiner (a)

(b)

SCREEN DEVICE

TECHNICAL FIELD

The present invention relates to a screen device which can be used mainly as a curtain and a blind, and also as a screen window and a partition.

BACKGROUND ART

The present applicant proposes a multi-purpose screen device described in Patent Document 1 given below. The present applicant also develops some variations on the basis of the above-described screen device.

Those screen devices all include a pair of slide guide frames which are withdrawn and retracted in the directions of opening and closing of the screen. The slide guide frames each are formed by coupling a plurality of rigid units to each other so as to be rotatable between the adjacent two units, and are configured to be bendable in one direction and not to be bendable in the other direction to maintain its linearity.

Also, a screen device disclosed in Patent Document 2 given below is provided with a roller pipe having a coil spring integrated therein, and is configured in such a manner that one end portion of the screen is fixed to the roller pipe, and the screen can be wound around the roller pipe and withdrawn therefrom at the time of opening and closing, so that a smooth and stable opening and closing operation is achieved.

PATENT DOCUMENT

Patent Document 1: Japanese Patent No. 3323461
Patent Document 2: JP-A-2005-351046

SUMMARY OF INVENTION

Problems to be Solved by the Invention

The screen device described in Patent Document 2 is used for general purpose from its superior opening and closing operability, workability, and the like. However, adequate control of a rotational force of a roller pipe according to the size, structure, shape, and so on of the screen to be wound is necessary. The rotational force of the roller pipe is driven by a resilient force generated by a coil spring integrated in the roller pipe as a power source. In the related art, an adequate magnitude of resilient force is expressed by applying torsion in advance to the coil spring, which is referred to as an initial winding, in a screen device manufacturing plant.

However, there are some sizes of openings which are slightly different from each other in buildings where the screen devices are to be installed depending on how they are built although it is standardized to some extent in many cases.

Therefore, if the initial winding of the coil spring which is applied in advance in the manufacturing plant can be adjusted in the field of execution, adjustment in the field is enabled, so that provision of a screen device superior in opening-and-closing operability, manner it is retracted is expected, and so on. In the related art, in the screen device similar to the screen device described in Patent Document 2, the type which allows adjustment of the initial winding of the coil spring integrated in the roller pipe is not proposed.

In view of such circumstances as described above, it is an object of the present invention to provide a screen device which allows adjustment of initial winding of a coil spring integrated in a roller pipe, and superior in opening-and-closing operability of a screen, manner it is retracted, and so on.

Means for Solving the Problems

In order to solve the above-described problems, the present invention has following characteristics.

A first invention is a screen device including: a screen to be opened and closed sideward; a roller pipe to which one of left and right ends of the screen is attached, the roller pipe configured to be rotated by a resilient force of an integrated coil spring and wind the screen on an outer periphery thereof; a screen mounting frame being slidable in the direction of opening and closing of the screen with respect to the roller pipe fixed to a predetermined position, to which one end of the screen positioned on the opposite side from the end attached to the roller pipe is attached; and an upper slide guide frame portion disposed in the vicinity of an upper end of the screen and a lower slide guide frame portion disposed in the vicinity of a lower end of the screen, the upper slide guide frame portion being made up of a plurality of first rigid units each having a pair of side wall portions arranged so as to face each other and a bridging portion connecting the both side wall portions with respect to each other by being coupled so as to be rotatable between the adjacent two units, the lower slide guide frame portion being made up of a plurality of second rigid units each having a pair of side wall portions arranged so as to face each other and a bridging portion connecting the both side wall portions with respect to each other by being coupled so as to be rotatable between the adjacent two units, the upper slide guide frame portion and the lower slide guide frame portion both having flexibility and each having a free end at one end thereof, the free end being able to be retracted into and withdrawn from the interior of the screen mounting frame and, in contrast, when having been withdrawn from the screen mounting frame in association with the sliding movement of the screen mounting frame, the portion withdrawn from the screen mounting frame keeping their linearity, characterized in that, the roller pipe includes a revolving shaft on which the coil spring is wound integrated therein, connected to a rotator rotatably disposed with respect to a stator connected to a lower end of the revolving shaft, and is rotatably retracted in a housing frame, the stator includes a plurality of radially arranged claws; holding portions arranged radially corresponding to the claws of the stator are disposed on a lower surface portion of a cap member which is detachably disposed at a lower end of the housing frame, the holding portions each have a holding space for receiving the claw in the interior thereof, the holding space is opened outward at one end on the side of receiving the claw and closed at the other end.

In the characteristics of the first invention, a second invention is characterized in that the size of the first rigid unit is smaller than the size of the second rigid unit, and when the upper slide guide frame portion and the lower slide guide frame portion are retracted into the interior of the screen mounting frame, the side wall portions of the first rigid units are fitted into the inner side of the side wall portions of the second rigid units, and the upper slide guide frame portion intersects the lower slide guide frame portion in the interior of the screen mounting frame.

In the characteristic in the first or second invention, a third invention is characterized in that a fixed portion to which the lower slide guide frame portion is coupled is disposed on the cap member, the fixed portion includes a pair of side wall portions arranged so as to oppose to each other corresponding to the second rigid unit which forms the lower slide guide frame portion and a bridging portion which connects the both side wall portions to each other.

Advantage of the Invention

According to the first invention, by rotating the stator connected to the lower end of the revolving shaft, the coil spring wound around the revolving shaft can be twisted or restored, so that the resilient force expressed by the coil spring can be adjusted. Therefore, the initial winding applied to the coil spring in advance in the manufacturing plant can be adjusted in the field of execution, so that the coil spring can be caused to express the resilient force of an optimal magnitude corresponding to the size, structure, shape and the like of the screen. Adjustment of the resilient force as such can be performed as a fine adjustment of the initial winding in the manufacturing plant. After having adjusted, since the claws of the stator are locked in the holding spaces in the interior of the holding portions disposed on the lower surface of the cap member, the coil spring is maintained stable in the adjusted state. The screen device superior in opening-and-closing operability of a screen and manner it is retracted is provided.

According to the second invention, in addition to the effects of the first invention, since the lower slide guide frame portion made up of the larger second rigid units can be retracted into the interior of the screen mounting frame, the upper slide guide frame portion made up of the smaller first rigid units can be retracted into the interior of the screen mounting frame with a space allowance with respect to the screen mounting frame. Therefore, connection between the second rigid units can be released by inserting a tool such as a screw driver into the interior of the screen mounting frame. When adjusting the length of the screen device, the upper slide guide frame portion positioned on the cutting side can be taken out from the interior of the screen mounting frame, and the taking out operation is easy because it can be performed at an arbitrary position of the upper slide guide frame. Therefore, the length adjusting work on the screen device is facilitated.

According to the third invention, in addition to the first or the second invention, the fixed portion disposed on the cap member corresponds to the second rigid unit which forms the lower slide guide frame portion, so that the lower slide guide frame portion can be easily fixed to the roller pipe side while enabling the maintenance of bendability and linearity.

DETAILED DESCRIPTION OF THE INVENTION

Figure 1:
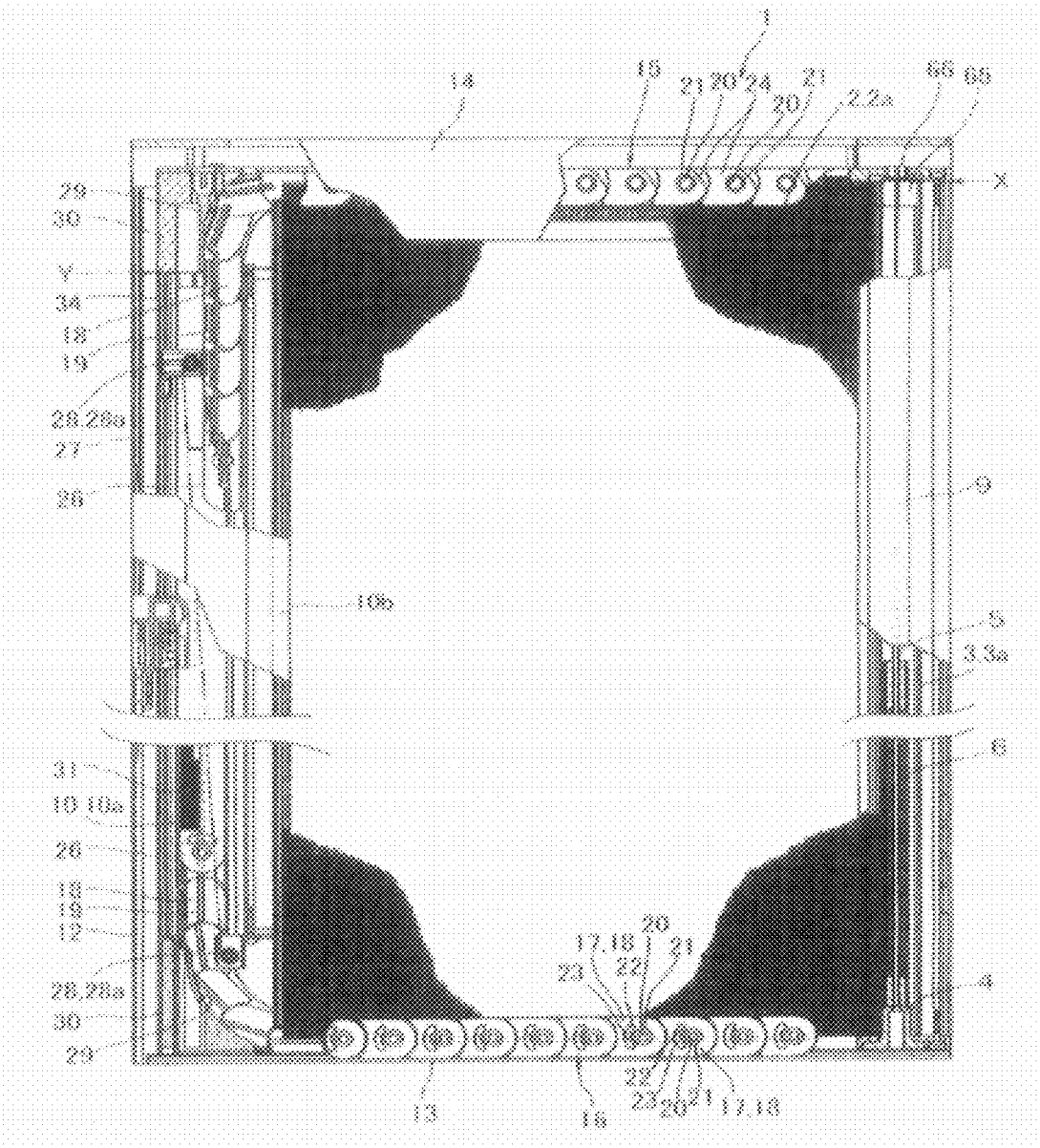
FIG. 1 is a vertical cross-sectional view showing an embodiment of a screen device according to the present invention.
Figure 2:
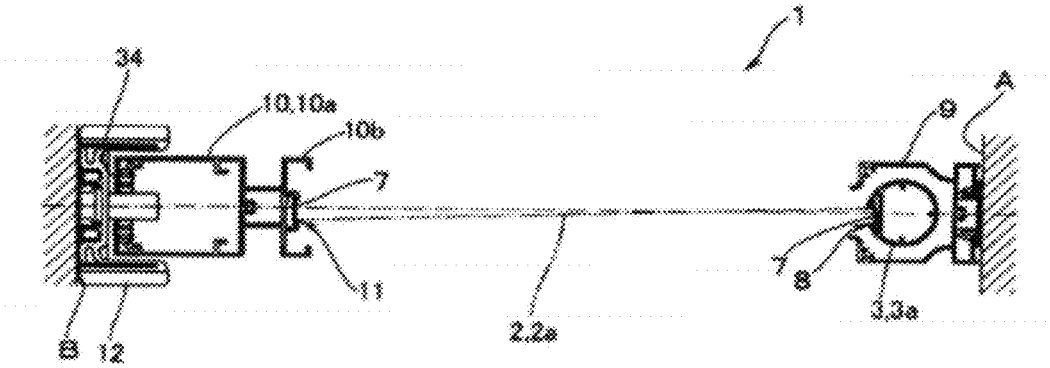
FIG. 2 is a lateral cross-sectional view of the screen device shown in FIG. 1.

As described above, FIGS. 1 and 2 are a vertical cross-sectional view and a lateral cross-sectional view showing an embodiment of a screen device of the present invention, respectively. On the other hand, FIGS. 3<*a*> <*b*> are cross-sectional views of a principal portion showing a state in which an upper slide guide frame portion and a lower slide guide frame portion of the screen device shown in FIG. 1 are retracted into a screen mounting frame, respectively, and FIG. 4 is a plan view of a principal portion showing the upper slide guide frame portion shown in FIG. 3 with coupling and decoupling of first rigid units.

A screen device 1 includes a net 2*a* as a screen 2 to be opened and closed sideward. The screen 2 is formed of a cloth such as woven fabric or a knitted fabric, and is selected as needed according to required characteristics such as those having a light proof property or those usable as mosquito screening. In this embodiment, the net 2*a* applied as the mosquito screening is employed. Also, plaiting can be applied as needed irrespective of the shape of the screen 2 including the net 2*a*.

A right end of the screen 2 is attached to a roller pipe 3 arranged vertically and, for example, to be fixed to an architrave A on the right side of an opening formed into a rectangular shape and extending in the vertical direction in a building.

The roller pipe 3 includes a substantially cylindrical-shaped hollow main body 3*a* and a bearing 4 to which the main body 3*a* is connected thereto at a lower end portion thereof. Disposed in the interior of the main body 3*a* is a revolving shaft 5, and the revolving shaft 5 extends from the bearing 4 to a midpoint of the roller pipe 3 in the height direction. Also, a coil spring 6 is integrated in the main body 3*a* and the coil spring 6 is disposed around the revolving shaft 5. A resilient force is accumulated in the coil spring 6 when twisted, and when the accumulated resilient force is released, the main body 3*a* rotates automatically about the revolving shaft 5. At this time, the screen 2 attached at one end thereof to the roller pipe 3 is wound around an outer periphery of the main body 3*a*. When the wound screen 2 is withdrawn in the closing direction, the main body 3*a* of the roller pipe 3 rotates in the opposite direction from the direction described above, the coil spring 6 is twisted, and a resilient force is accumulated.

Elongated fixing members 7 extending in the vertical direction are disposed on both left and right end portions of the screen 2. The main body 3*a* of the roller pipe 3 is formed with a slot 8 extending in the vertical direction, and the slot 8 is opened outward of the main body 3*a*. The screen 2 is attached to the roller pipe 3 at a right end thereof by the fixing member 7 inserted into the slot 8. Incidentally, both upper ends of the screen 2 and the roller pipe 3 are arranged in alignment at the same position as indicated by an arrow X in FIG. 1.

Also, the roller pipe 3 is retracted in the interior of a hollow housing frame 9, and the housing frame 9 is fixed to the architrave A on the right side of the opening of the building.

A left end of the screen 2 is attached to a screen mounting frame 10 which is slidable with respect to the roller pipe 3 in the direction of opening and closing of the screen 2. The screen mounting frame 10 includes a hollow main body 10*a* in a square tube shape having a square cross section, and a screen mounting portion 10*b* positioned on the side of the roller pipe 3 and projecting rightward, and is arranged in the vertical direction. The screen mounting portion 10*b* has a substantially angular U-shaped cross-section, and is opened rightward. Also, the screen mounting portion 10*b* is formed with a slot 11 on an inner side surface portion opposing the roller pipe 3. The screen 2 is attached to the screen mounting frame 10 by the fixing member 7 disposed on the left end portion thereof inserted into the slot 11. A door stop frame 12 is disposed on an architrave B extending in the vertical direction on the left side of the opening of the building, and the screen mounting frame 10 is slidable between the door stop frame 12 and the housing frame 9 sideward. The screen 2 is openable and closable by the sliding movements of the screen mounting frame 10 as described above.

The screen device 1 also includes a lower rail 13 disposed on, for example, a floor surface, and an upper rail 14 disposed on an upper architrave extending in the lateral direction of the opening of the building so as to achieve smooth sliding movements of the screen mounting frame 10. The lower rail 13 may be formed to have, for example, an elongated rod shape. The upper rail 14 may be formed to have, for example, a frame having an angular U-shape in cross section. In this case, the upper rail 14 can cover over upper end portions of the screen mounting frame 10, the screen 2, and the roller pipe 3 from both front and back sides of the screen device 1, and contributes to improvement of appearance of the screen device 1.

When opening and closing the screen 2, an operator can place his/her hand on the screen mounting frame 10 and slide the screen mounting frame 10 sideward, and the screen mounting frame 10 is guided from the inside by the lower rail 13, and is guided from the outside by the upper rail 14 and hence is slid sideward smoothly in the opening of the building. The screen mounting frame 10 can be provided with a hand grip on a front surface portion thereof, and also with a hand grip as needed on a back surface portion thereof, so as to facilitate opening and closing operations by the operator.

In the screen device 1, an upper slide guide frame portion 15 is disposed near the upper end of the screen 2, and a lower slide guide frame portion 16 is disposed near a lower end of the screen 2. Both the upper slide guide frame portion 15 and the lower slide guide frame portion 16 serve to arrange the screen mounting frame 10 in parallel to the roller pipe 3, keep the parallel positional relationship with respect to the roller pipe 3 also at the time of sliding movements of the screen mounting frame 10, thereby ensuring the opening and closing of the screen 2. The slide guide frame portions disclosed in Patent Publication No. 3403652 and Patent Publication No. 3323461 of the present applicant are applied to the upper slide guide frame portion 15 and the lower slide guide frame portion 16 as described above.

In other words, the lower slide guide frame portion 16 is made up of a plurality of second rigid units 17 coupled so as to be rotatable between the adjacent two units. The second rigid unit 17 includes a pair of side wall portions 18 arranged so as to face each other, and a bridging portion 19 connecting the both side wall portions 18 at a position near an upper end portion of the side wall portion 18 from a substantially center portion to a right end portion. The side wall portion 18 is formed with a projection 20 provided at a left end portion thereof so as to project outward and a through hole 21 which allows engagement of the projection 20 therewith at the right end portion thereof and penetrates through the side wall portion 18 from the front to the back. The plurality of the second rigid units 17 in this manner are coupled by inserting the projection 20 into the through hole 21 from the back side of the side wall portion 18 between the adjacent two units, thereby forming the lower slide guide frame portion 16. Also, since the projection 20 engages the through hole 21, the second rigid units 17 are rotatable with respect to each other between the adjacent two units, and the lower slide guide frame portion 16 has flexibility in conjunction with this rotation.

In addition, the second rigid unit 17 includes a small projection 22 projecting outward from the side wall portion 18 disposed on the left side of the projection 20, and a substantially croissant-shaped elongated hole 23 formed in the side wall portion 18 on the left side of the through hole 21 so as to be penetrated therethrough from the front to the back. The elongated hole 23 is capable of receiving the small projection 22, and when coupling the second rigid units 17, the small projection 22 is inserted into the interior of the elongated hole 23. Since the small projection 22 is inserted into the elongated hole 23 in this manner, between the adjacent two second rigid units 17, the rotation of the second rigid unit 17 is restricted when the small projection 22 comes into contact with one end of the elongated hole 23. Therefore, the lower slide guide frame portion 16 can keep its linearity.

The upper slide guide frame portion 15 is also configured basically in the same manner as the lower slide guide frame portion 16. In other words, a first rigid unit 24 includes the pair of side wall portions 18 arranged so as to face each other and the bridging portion 19 connecting the both side wall portions 18, and the side wall portion 18 is provided with the projection 20 and formed with the through hole 21. The upper slide guide frame portion 15 is made up of a plurality of the first rigid units 24 coupled by inserting the projection 20 into the through hole 21 between the adjacent two units. The upper slide guide frame portion 15 also has flexibility in the same manner as the lower slide guide frame portion 16.

In contrast, the small projection 22 and the through hole 23 are omitted on the first rigid units 24 which constitute the upper slide guide frame portion 15. Instead, the first rigid unit 24 is provided with a shoulder 25 formed by notching a surface on a right end edge portion of the bridging portion 19. Between the adjacent two first rigid units 24, a left end portion of the bridging portion 19 of one of the first rigid units 24 is configured to be capable of overlapping with the shoulder 25 formed on the right end edge portion of the bridging portion 19 of the other first rigid unit 24, whereby the rotation of the first rigid unit 24 is restricted when being overlapped to each other. Therefore, the upper slide guide frame portion 15 is also capable of keeping its linearly in the same manner as the lower slide guide frame portion 16.

Incidentally, the upper slide guide frame portion 15 is capable of bending downward, and the lower slide guide frame portion 16 is capable of bending upward.

Both of the first rigid units 24 and the second rigid units 17 which constitute the upper slide guide frame portion 15 and the lower slide guide frame portion 16 in this manner may be formed of materials having good formability such as resin, or metal. Also, when being formed of resin or metal, the side wall portion 18 on the right side can be opened outward by its resiliency as shown in FIG. 4, and in addition, can be restored spontaneously to its original state. Therefore, coupling and decoupling of the plurality of first rigid units 24 and second rigid units 17 are easy.

Also, the upper slide guide frame portion 15 and the lower slide guide frame portion 16 both have a fixed end at right ends thereof, and are fixed to the roller pipe 3 side. In contrast, left ends are free ends 26, and are arranged in the interior of the main body 10*a* of the screen mounting frame 10, so that the upper slide guide frame portion 15 and the lower slide guide frame portion 16 are configured to be capable of being retracted into and withdrawn from the interior of the main body 10*a* of the screen mounting frame 10.

At the free ends 26, the upper slide guide frame portion 15 and the lower slide guide frame portion 16 are coupled to each other by a tension member 27 selected suitably from wire materials such as a cord or a wire. The amounts of movement of the upper slide guide frame portion 15 and the lower slide guide frame portion 16 to the outside and to the inside of the main body 10*a* in association with the sliding movement of the screen mounting frame 10 are substantially equal by the coupling using the tension member 27, and hence the parallel movement of the screen mounting frame 10 with respect to the roller pipe 3 is further ensured. The tension member 27 is formed into a loop in the interior of the main body 10*a* of the screen mounting frame 10, and is folded backward at both upper and lower sides of the screen mounting frame 10.

Fold back members 28 are disposed at two positions at upper and lower portions in the interior of the screen mounting frame 10 where the tension member 27 is folded back. The fold back members 28 each may be configured as a member including a pulley 28*a* having a curved surface of a hand drum shape which allows the tension member 27 to be wound thereon.

In addition, in the screen mounting frame 10, guide blocks 30 are disposed at both upper and lower end portions thereof where the upper slide guide frame portion 15 and the lower slide guide frame portion 16 move forward and backward, and the guide blocks 30 each have a guide surface 29 for guiding bending of the upper slide guide frame portion 15 and the lower slide guide frame portion 16 on an inner side thereof. The guide blocks 30 are connected to both upper and lower ends of the main body 10*a* of the slide guide frame portion 10. The upper guide block 30 has the guide surface 29 bent into a concave shape from the right side end toward the lower end, and the lower guide block 30 has the guide surface 29 bent into a concave shape from the right side end toward the upper end. Also, the fold back member 28 which folds back the tension member 27 at the lower side of the screen mounting frame 10 is attached to the lower guide block 30. In contrast, the upper fold back member 28 is attached to a position slightly lower than the upper end of the main body 10*a* of the screen mounting frame 10.

The upper slide guide frame portion 15 and the lower slide guide frame portion 16 are retracted into the interior of the main body 10*a* of the screen mounting frame 10 in association with the sideward sliding movement of the screen mounting frame 10, and is also withdrawn therefrom. Portions withdrawn from the screen mounting frame 10 keep its linearly by the first rigid units 24 and the second rigid units 17 configured as described above.

Incidentally, since the lower slide guide frame portion 16 is retracted into the interior of the main body 10*a* from below the screen mounting frame 10, the retracting direction is opposite from the direction of gravitational force. Therefore, a weight 31 is connected to the free end 26 thereof. The weight 31 applies its own weight to a portion of the lower slide guide frame portion 16 rising upward from the bottom, and when the lower slide guide frame portion 16 is withdrawn from the screen mounting frame 10, the lower slide guide frame portion 16 is pushed out in moderation. Also, when the lower slide guide frame portion 16 is retracted into the interior of the main body 10*a* of the screen mounting frame 10, the entry of the lower slide guide frame portion 16 is suppressed in moderation. Therefore, the lower slide guide frame portion 16 is retracted into and withdrawn from the interior of the main body 10*a* of the screen mounting frame 10 is realized smoothly and stably.

Figure 5:
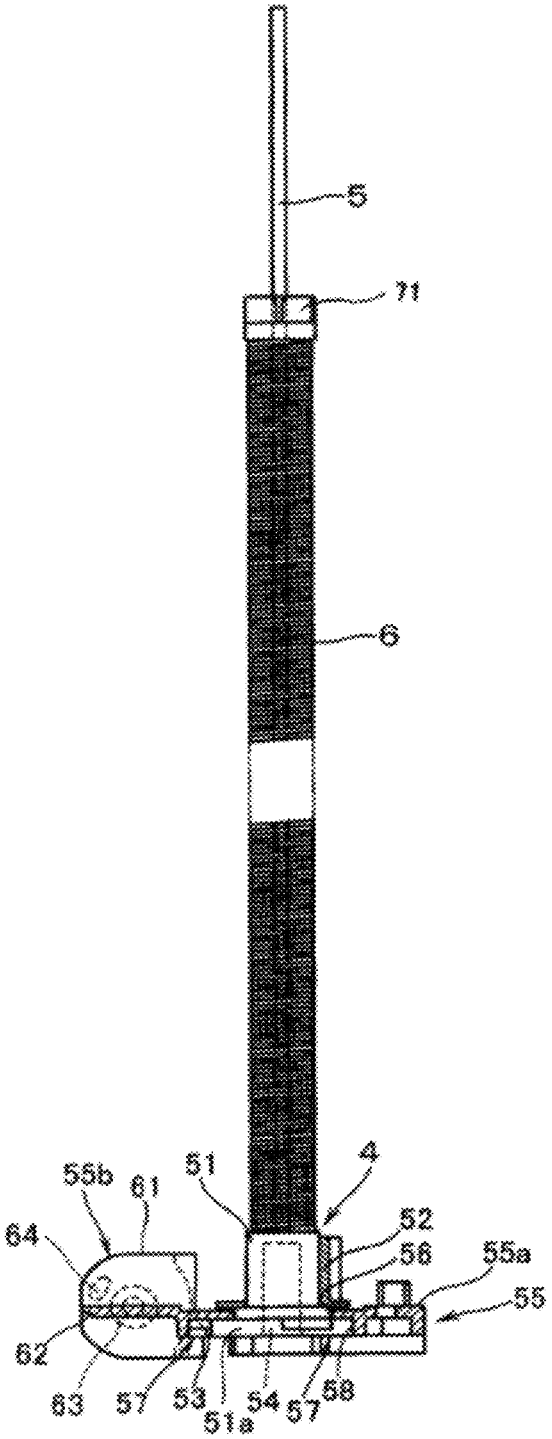
FIG. 5 is a vertical cross-sectional view showing a principal portion in the periphery of a coil spring in a roller pipe disposed in the screen device shown in FIG. 1.
Figure 6:
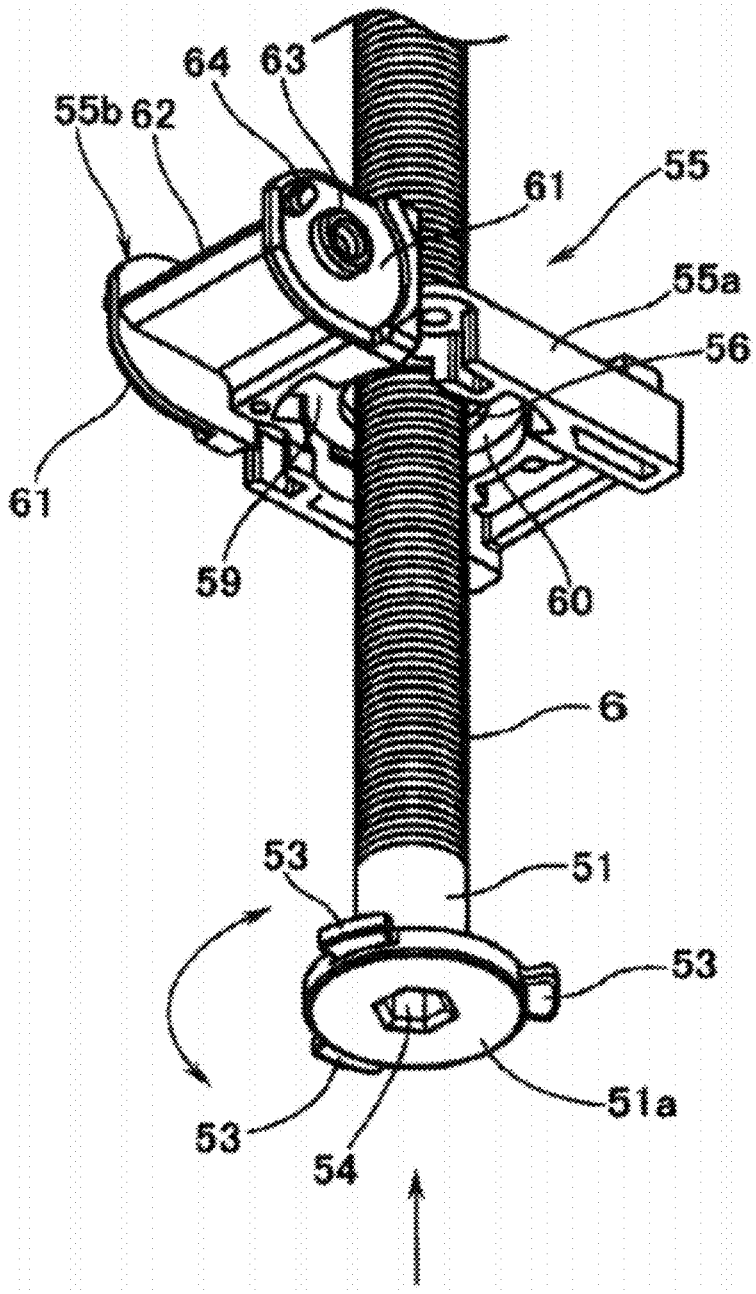
FIG. 6 is a perspective view of a principal portion showing the periphery of the coil spring in the roller pipe corresponding to FIG. 5.
Figure 7:
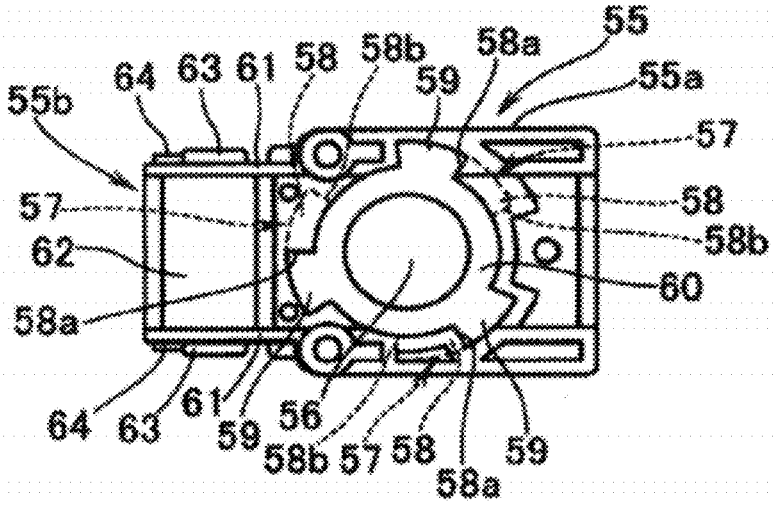
FIGS. 7<*a*> <*b*> are bottom views showing a cap member and a stator, respectively.
Figure 7:
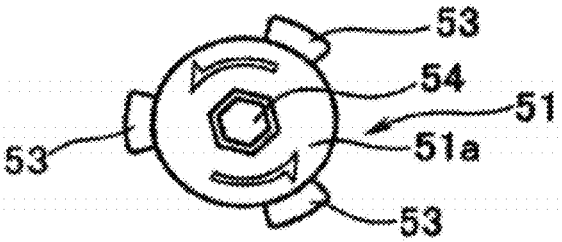

FIG. 5 is a vertical cross-sectional view of a principal portion showing the periphery of the coil spring 6 in the roller pipe 3 disposed in the screen device 1. FIG. 6 is a perspective view of a principal portion showing the periphery of the coil spring 6 in the roller pipe 3 corresponding to FIG. 5. FIGS. 7<*a*><*b*> are bottom views showing a cap member and a stator, respectively.

In the screen device 1, the bearing 4 includes a stator 51 connected to a lower end of the revolving shaft 5 and a rotator 52 arranged on the outer periphery of the stator 51 and disposed so as to be rotatable with respect to the stator 51. A lower end portion of the coil spring 6 is connected to the stator 51. An upper end portion of the coil spring 6 is fixed to a pillow 71. The pillow 71 is configured to be movable in the longitudinal direction with respect to the main body 3*a* of the roller pipe 3, but not to be relatively rotatable with respect to the main body 3*a* and to be rotatable together with the main body 3*a*.

The rotator 52 engages the lower end portion of the main body 3*a* of the roller pipe 3 shown in FIG. 1 from the inside and mounted to a lower end of the main body 3*a*. Therefore, the main body 3*a* of the roller pipe 3 is rotatable about the revolving shaft 5, and when the resilient force accumulated in the coil spring 6 wound around the revolving shaft 5 is released, the main body 3*a* rotates about the revolving shaft 5 automatically, so that the screen 2 can be wound around the periphery thereof as described above.

The stator 51 includes a disc-shaped main body 51*a* at a lower end thereof, and substantially arcuate-shaped claws 53 are disposed so as to project outward from the outer peripheral surface of the main body 51*a*. Three of the claws 53 are disposed, and the three claws 53 are arranged radially with respect to the main body 51*a*. The stator 51 includes a hexagon socket 54 formed at a center portion of the main body 51*a* upward from a lower surface. The hexagon socket 54 is a hole which allows insertion of a hexagonal wrench, and has a shape corresponding to the outside shape of the hexagonal wrench.

In the screen device 1, a cap member 55 configured to engage a lower end portion of the housing frame 9 where the roller pipe 3 is retracted from the inside and to be mounted on a lower end of the housing frame 9 is disposed. The cap member 55 includes a main body 55*a* having a size and a shape corresponding to the outside shape of the housing frame 9. The main body 55*a* is formed with an opening 56 at a center portion thereof so as to penetrate therethrough in the vertical direction. The revolving shaft 5, the coil spring 6, and the connecting portion of the stator 51 with respect to the revolving shaft 5 can be inserted through the inside of the opening 56. In contrast, the rotator 52 and the main body 3*a* of the roller pipe 3 cannot be inserted through the opening 56. The opening 56 is formed on the main body 55*a* of the cap member 55 so as to have a size which achieves the above-described operations.

Also, in the main body 55*a* of the cap member 55, three holding portions 57 are disposed on a lower surface portion in the periphery of the opening 56 so as to be arranged radially corresponding to the claws 53 of the stator 51. The holding portions 57 each have a bag shape having a holding space 58 for receiving the claw 53 therein. The holding space 58 is opened outward at one end 58*a* in the direction of receiving the claw 53 and closed at the other end 58*b*. Such a shape of the holding portion 57 corresponds to the outside shape of the claw 53 of the stator 51.

In addition, the lower surface portion in the periphery of the opening 56 of the main body 55*a* is formed with substantially arcuate-shaped arcuate grooves 59 so as to be adjacent to the holding portion 57. The arcuate grooves 59 also have a shape corresponding to the outside shape of the claw 53 of the stator 51. Then, a circular groove 60 having a circular shape is formed inside the arcuate groove 59. The size and shape of the circular groove 60 correspond to the outside shape of the main body 51*a* of the stator 51.

The coil spring 6 is applied with additional torsion to the initial winding by inserting the hexagonal wrench into the hexagon socket 54 formed on the main body 51*a* of the stator 51 and rotating the stator 51 in either leftward or rightward. When the stator 51 is rotated in the opposite direction, the torsion of the coil spring 6 may be restored and released. Therefore, the initial winding of the coil spring 6 can be adjusted by the rotation of the stator 51.

Incidentally, when adjusting the initial winding of the coil spring 6, the coil spring 6 and the revolving shaft 5 are pulled out downward from the cap member 55 through the opening 56 together with the stator 51. In this state, the rotation of the stator 51 as described above by the use of the hexagonal wrench is enabled.

After the adjustment, the revolving shaft 5 and the coil spring 6 are retracted in the interior of the main body 3*a* of the roller pipe 3. At this time, the state of being adjusted is maintained by inserting the claws 53 of the stator 51 into the holding spaces 58. Since the arcuate grooves 59 and the circular groove 60 are formed on the lower surface portion of the main body 55*a* of the cap member 55 as described above, the claws 53 of the stator 51 are inserted into the arcuate grooves 59 and the main body 51*a* is inserted into the circular groove 60, and then the stator 51 is rotated slightly leftward or rightward. Since the holding spaces 58 of the holding portions 57 are each opened outward at the one end 58*a*, the claw 53 enters into the holding space 58 from the one end 58*a* opened outward of the holding space 58 in association with the rotation of the stator 51. Then, when the claws 53 come into contact with the other ends 58*b* of the holding space 58, the rotation of the stator 51 is stopped. The claws 53 of the stator 51 are locked to the holding spaces 58 of the holding portions 57 and the coil spring 6 is held in a state in which the initial winding is adjusted.

In this manner, in the screen device 1, by rotating the stator 51 connected to the lower end of the revolving shaft 5, the coil spring 6 wound around the revolving shaft 5 can be twisted or restored, so that the resilient force expressed by the coil spring 6 can be adjusted. Therefore, the initial winding applied to the coil spring 6 in advance in the manufacturing plant can be adjusted in the field of execution, so that the coil spring 6 can be caused to express the resilient force of an optimal magnitude corresponding to the size, structure, shape and the like of the screen 2. Adjustment of the resilient force as such can be performed as a fine adjustment of the initial winding in the manufacturing plant. After having adjusted, since the claws 53 of the stator 51 are locked in the holding spaces 58 in the interior of the holding portions 57 disposed on the lower surface portion of the cap member 55 as described above, the coil spring 6 is maintained stable in the adjusted state. The screen device 1 is superior in opening-and-closing operability of the screen 2, manner it is retracted, and so on.

In addition, in the screen device 1, a fixed portion 55*b* of the lower slide guide frame portion 16 is disposed at a left end of the main body 55*a* of the cap member 55. The fixed portion 55*b* has the similar configuration as a left half of the second rigid unit 17 of the lower slide guide frame portion 16.

In other words, the fixed portion 55*b* includes a pair of side wall portions 61 arranged so as to oppose to each other, and a bridging portion 62 which connects the both side wall portions 61 each other at a position near an upper end portion of the side wall portions 61. On the side wall portion 61, a projection 63 is disposed so as to project outward at a left end portion thereof and a small projection 64 projecting outward from the side wall portion 61 on the left side of the projection 63 is disposed.

Therefore, the lower slide guide frame portion 16 is coupled to the fixed portion 55*b* of the cap member 55 by inserting the projection 63 of the fixed portion 55*b* from the back surface side of the side wall portion 18 into the through hole 21 of the second rigid unit 17 positioned on a right end thereof. In association with such coupling, the small projection 64 of the fixed portion 55*b* of the cap member 55 is inserted into the elongated hole 23 of the second rigid unit 17 positioned at a right end of the lower slide guide frame portion 16.

In this manner, the right end of the lower slide guide frame portion 16 serves as a fixed end and is fixed to the housing frame 9 on the side of the roller pipe 3. In the lower slide guide frame portion 16, the second rigid unit 17 is freely rotatable within a range in which the small projection 64 comes into contact with the both ends of the elongated hole 23 also at the right end thereof and is bendable, and, in addition, is capable of maintaining its linearity. Also, by the fixed portion 55*b* disposed on the cap member 55, the fixation on the side of the roller pipe 3 of the lower slide guide frame portion 16 can be realized easily.

In the screen device 1, since the roller pipe 3 is already retracted in the interior of the housing frame 9 at the time of assembly, it is necessary to pull out the screen 2 slightly from the roller pipe 3 when mounting the screen 2 on the screen mounting frame 10. The margin of the screen 2 to be pulled out is small, and little resilient force is accumulated in the coil spring 6. Therefore, there is a risk of failure in closed state such that the screen 2 cannot be wound completely in the screen device 1 after installation unless the amount of the screen 2 corresponding to the margin thereof to be pulled out is wound around the outer periphery of the roller pipe 3.

Therefore, in the screen device 1, an upper cap 65 is disposed at an upper end of the main body 3*a* of the roller pipe 3 and an insertion groove 66 to allow insertion of a tool such as a screw driver is formed at an upper end of the upper cap 65. The upper cap 65 engages the upper end portion of the main body 3*a* of the roller pipe 3 from inside and is demountably mounted on the upper end of the main body 3*a*.

As described above, after having mounted the screen 2 on the screen mounting frame 10, the tool such as the screw driver is inserted into the insertion groove 66, and the roller pipe 3 is rotated in the direction of winding the screen 2, so that the screen 2 can be wound on the outer periphery of the roller pipe 3 completely.

Then, in the upper slide guide frame portion 15 and the lower slide guide frame portion 16, the sizes of the first rigid units 24 and those of the second rigid units 17 are different.

Figure 3:
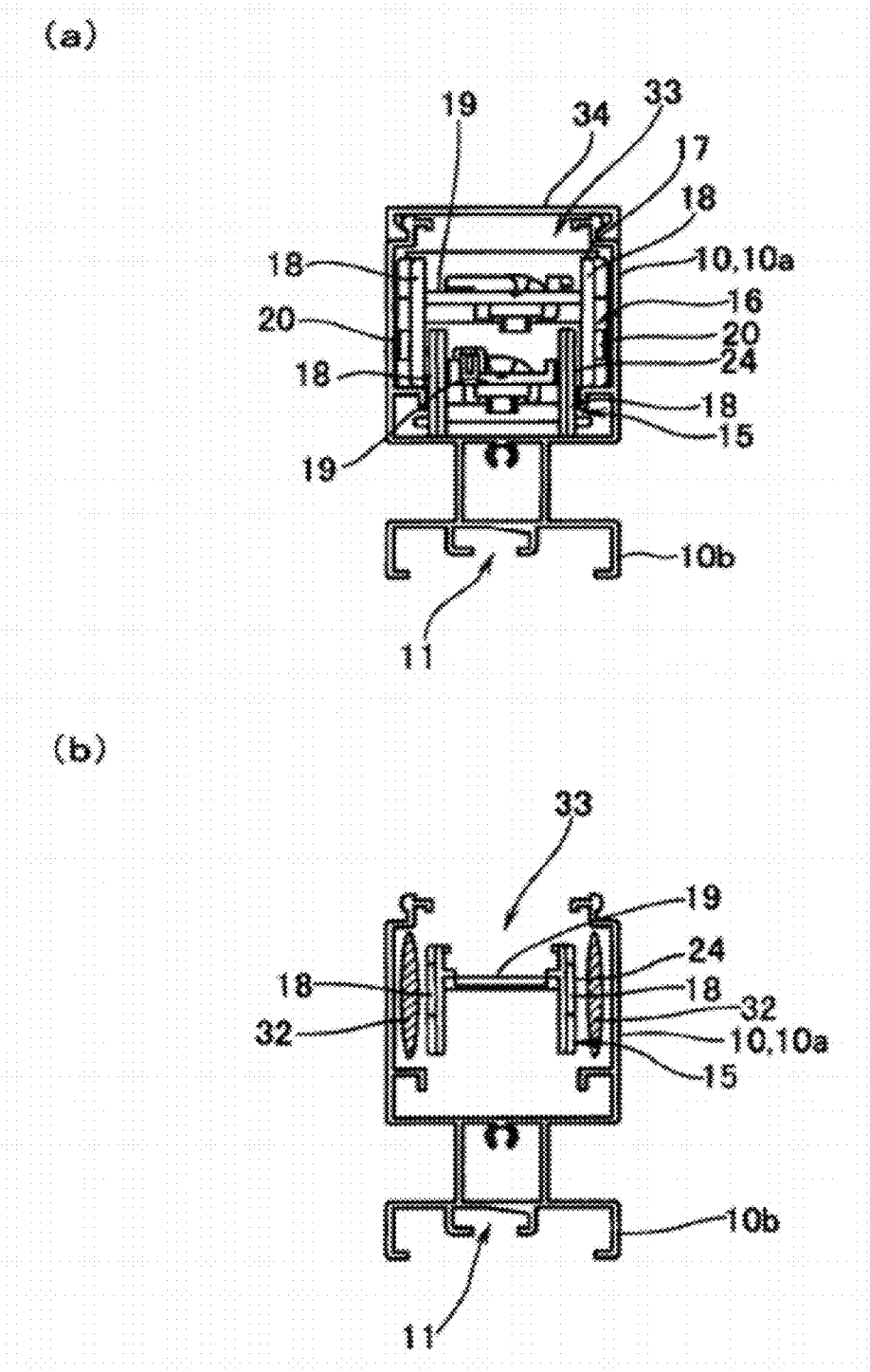
FIGS. 3<*a*> <*b*> are cross-sectional views of a principle portion showing a state in which an upper slide guide frame portion and a lower slide guide frame portion of the screen device shown in FIG. 1 are retracted into a screen mounting frame, respectively.
Figure 4:
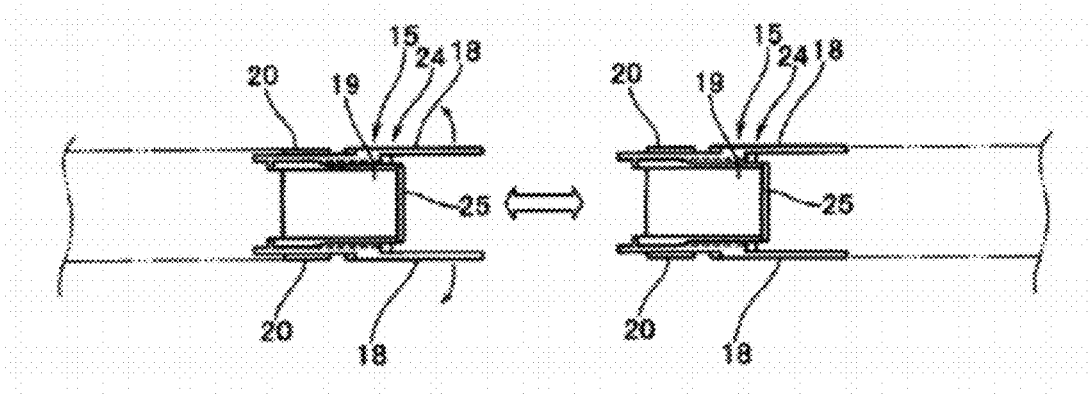
FIG. 4 is a plan view of a principal portion showing the upper slide guide frame portion shown in FIG. 3 with coupling and decoupling of first rigid units.

As shown in FIG. 3<*a*>, the size of the first rigid unit 24 which constitutes the upper slide guide frame portion 15 is smaller than the size of the second rigid unit 17 which constitutes the lower slide guide frame portion 16 in all dimensions, namely, lateral width, depth, and height. Therefore, in the screen device 1, when the upper slide guide frame portion 15 and the lower slide guide frame portion 16 are retracted into the interior of the main body 10*a* of the screen mounting frame 10, the side wall portions 18 of the first rigid units 24 are fitted into the inner side of the side wall portions 18 of the second rigid units 17, and the upper slide guide frame portion 15 intersects the lower slide guide frame portion 16 in the interior of the main body 10*a* of the screen mounting frame 10. Such an intersection allows application of the screen device 1 into the opening in the building, whose ratio of the width to the length is large, and allows flexible adaptation to the dimensions of the opening in the building.

Also, since the lower slide guide frame portion 16 made up of the larger second rigid units 17 can be retracted into the interior of the main body 10*a* of the screen mounting frame 10, the upper slide guide frame portion 15 made up of the smaller first rigid units 24 is retracted into the interior of the main body 10*a* of the screen mounting frame 10 with a space allowance 32 with respect to the main body 10*a* of the screen mounting frame 10 as shown in FIG. 3<*b*>. Therefore, coupling between the first rigid units 24 can be released by inserting the tool such as the screw driver into the interior of the main body 10*a* of the screen mounting frame 10.

The screen device 1 needs adjustment of the length in the field of execution according to the size of the opening in the building as described above. In the length adjustment work in this case, the upper end portions of the screen mounting frame 10, the screen 2, and the roller pipe 3 are cut. However, if the upper slide guide frame portion 15 is disposed in the vicinity of the upper end of the screen 2 at this time, the upper slide guide frame portion 15 works against the length adjustment work. In the screen device 1, as described above, since the upper slide guide frame portion 15 is retracted into the interior of the main body 10*a* of the screen mounting frame 10 with the space allowance 32 with respect to the main body 10*a* of the screen mounting frame 10, the upper slide guide frame portion 15 can be taken out from the interior of the main body 10*a* of the screen mounting frame 10 by releasing the coupling between the first rigid units 24 at the time of the length adjustment work.

The main body 10*a* of the screen mounting frame 10 is formed with an opening 33 on a front surface portion opposing the door stop frame 12, and the interior of the main body 10*a* is openable toward the outside. A cover 34 is detachably mounted on the opening 33 on the front surface portion of the main body 10*a*. Therefore, by removing the cover 34, the tool such as the screw driver can be inserted into the interior of the main body 10*a* through the opening 33. Also, insertion of the tool can be performed at an arbitrary position in the range of the length of the main body 10*a* of the screen mounting frame 10.

In this manner, in the screen device 1, when adjustment of the length by cutting in the field of execution or the like is required, the upper slide guide frame portion 15 can be taken out from the screen mounting frame 10 by releasing the connection between the first rigid units 24 and, in addition, taking out of the upper slide guide frame portion 15 is easy because it can be performed at an arbitrary position in the range of the length of the main body 10*a* of the screen mounting frame 10. The length adjustment work on the screen device 1 is facilitated.

Also, as described above, in the screen device 1, the fold back member 28 for folding back the tension member 27 on the upper side of the screen mounting frame 10 is mounted to a position slightly lower than the upper end of the main body 10*a* of the screen mounting frame 10. Therefore, the upper fold back member 28 can be arranged on the lower side with respect to the cutting position of the screen device 1. Therefore, cutting of the screen mounting frame 10 on the upper end side is enabled without removing the tension member 27 from the fold back member 28. The tension member 27 does not work against the length adjustment work of the screen device 1, and it is not necessary to detach the upper fold back member 28 once and reattach the same to the screen mounting frame 10. The length adjustment work on the screen device 1 can be performed easily.

Incidentally, assembly of the upper slide guide frame portion 15 after the length adjustment work and attachment of the same into the interior of the main body 10*a* of the screen mounting frame 10 can be performed easily in the reverse order of the taking out operation.

In addition, intersection of the upper slide guide frame portion 15 with the lower slide guide frame portion 16, which enables release of coupling between the first rigid units 24 as described above can be realized easily, for example, by arranging the guide surface 29 of the upper guide block 30 disposed on the upper end portion of the screen mounting frame 10 on the side of the screen mounting portion 10*b* with respect to the guide surface 29 of the guide block 30 disposed on the lower side.

In addition, in the screen device 1, since the upper ends of the screen 2 and the roller pipe 3 are arranged at the same position as described above, the main body 3*a* of the roller pipe 3 can be cut at a time together with the screen 2. As described above, the revolving shaft 5 does not exist at a portion on the upper end side in the main body 3*a* of the roller pipe 3. The upper end side of the main body 3*a* of the roller pipe 3 can be cut because it has a simple hollow pipe shape.

When cutting the main body 3*a* of the roller pipe 3, the upper cap 65 can be removed. Also, the upper cap 65 is detachably inserted to an upper end of the main body 3*a* of the roller pipe 3 after cut.

Also, by aligning the upper end of the screen mounting frame 10 with the upper end of the screen 2, the screen mounting frame 10 can also be cut at a time. In this manner, the length adjustment work of the screen device 1 is further facilitated.

Although the present invention has been described along the embodiment thus far, the present invention is not limited to the embodiment. Various detailed configurations and structures of the respective portions may be selected as needed considering functions or the like which are to be carried out by respective portions.

REFERENCE NUMERALS

1 screen device
2 screen
3 roller pipe
5 revolving shaft
6 coil spring
9 housing frame
10 screen mounting frame
15 upper slide guide frame portion
16 lower slide guide frame portion
17 second rigid unit
18 side wall portion
19 bridging portion
24 first rigid unit
51 stator
52 rotator
53 claw
55 cap member
55*b* fixed portion
57 holding portions
58 holding space
58*a* one end of holding space
58*b* the other end of holding space
61 side wall portion
62 bridging portion

The invention claimed is:

1. A screen device comprising:

a screen to be opened and closed sideward;

a roller pipe to which one of left and right ends of the screen is attached, the roller pipe configured to be rotated by a resilient force of an integrated coil spring and wind the screen on an outer periphery thereof;

a screen mounting frame being slidable in a direction of opening and closing of the screen with respect to the roller pipe fixed to a predetermined position, to which one end of the screen positioned on an opposite side from the end attached to the roller pipe is attached; and an upper slide guide frame portion disposed in the vicinity of an upper end of the screen and a lower slide guide frame portion disposed in the vicinity of a lower end of the screen, the upper slide guide frame portion being made up of a plurality of first rigid units each having a pair of side wall portions arranged so as to face each other and a bridging portion connecting both side wall portions with respect to each other by being coupled so as to be rotatable between adjacent ones of the first rigid units, the lower slide guide frame portion being made up of a plurality of second rigid units each having a pair of side wall portions arranged so as to face each other and a bridging portion connecting both side wall portions with respect to each other by being coupled so as to be rotatable between adjacent ones of the second rigid units, the upper slide guide frame portion and the lower slide guide frame portion both having flexibility and each having a free end at one end thereof, the free end being able to be retracted into and withdrawn from the interior of the screen mounting frame and, in contrast, when having been withdrawn from the screen mounting frame in association with the sliding movement of the screen mounting frame, the portion withdrawn from the screen mounting frame keeping their linearity, wherein the roller pipe includes a revolving shaft on which the coil spring is wound integrated therein, connected to a rotator rotatably disposed with respect to a stator connected to a lower end of the revolving shaft, and is rotatably refracted in a housing frame, wherein the stator includes a disc-shaped main body at a lower end thereof, and arcuate-shaped claws which project outward from an outer peripheral surface of the main body of the stator, wherein a hexagon socket is formed at a center portion of the main body of the stator upward from a lower surface of the main body of the stator, the hexagon socket allowing insertion of a hexagonal wrench and having a shape corresponding to an outside of the hexagonal wrench, wherein a cap member is detachably disposed at a lower end of the housing frame, an opening penetrating a main body of the cap member in a vertical direction of the main body of the cap member is formed at a center portion of the main body of the cap member, and the cap member is capable of having the revolving shaft, the coil spring and a connecting portion of the stator with the revolving shaft inserted through the opening, but is incapable of having the rotator and a main body of the roller pipe inserted through the opening, wherein holding portions are disposed on a lower surface of the main body of the cap member in a periphery of the opening so as to be arranged radially, the holding portions each having a holding space for receiving one of the claws in the interior thereof, the holding space being opened outward at one end on a side for receiving the claw and closed at the other end, wherein arcuate-shaped grooves having a shape corresponding to an outside shape of one of the claws are formed at the lower surface of the main body of the cap member adjacent to the holding portions, and a circular groove having a shape corresponding to an outside shape of the main body of the stator is formed at an inside of the arcuate-shaped grooves, and wherein an upper end of the revolving shaft is disposed at a midpoint of the roller pipe in a height direction of the roller pipe.

2. The screen device according to claim 1, wherein the first rigid units each have a size which is smaller than that of the second rigid units, and when the upper slide guide frame portion and the lower slide guide frame portion are retracted into the interior of the screen mounting frame, the side wall portions of the first rigid units are fitted into the inner side of the side wall portions of the second rigid units, and the upper slide guide frame portion intersects the lower slide guide frame portion in the interior of the screen mounting frame.

3. The screen device according to claim 1, wherein a fixed portion to which the lower slide guide frame portion is coupled is disposed on the cap member, and wherein the fixed portion includes a pair of side wall portions arranged so as to oppose to each other corresponding to the second rigid unit which forms the lower slide guide frame portion and a bridging portion which connects both side wall portions to each other.

4. The screen device according to claim 2, wherein a fixed portion to which the lower slide guide frame portion is coupled is disposed on the cap member, and wherein the fixed portion includes a pair of side wall portions arranged so as to oppose to each other corresponding to the second rigid unit which forms the lower slide guide frame portion and a bridging portion which connects both side wall portions to each other.

* * * * *